US011273855B2

(12) United States Patent
Beier et al.

(10) Patent No.: US 11,273,855 B2
(45) Date of Patent: Mar. 15, 2022

(54) LED SHIELDING AND MONITORING SYSTEM AND WAYSIDE LED SIGNALS

(71) Applicant: Siemens Industry, Inc., Alpharetta, GA (US)

(72) Inventors: Axel Beier, Schildow (DE); Jeffrey Smith, Chippenham (GB)

(73) Assignee: Siemens Mobility, Inc., New York, NY (US)

( * ) Notice: Subject to any disclaimer, the term of this patent is extended or adjusted under 35 U.S.C. 154(b) by 685 days.

(21) Appl. No.: 16/310,098

(22) PCT Filed: Jun. 28, 2016

(86) PCT No.: PCT/US2016/039767
§ 371 (c)(1),
(2) Date: Dec. 14, 2018

(87) PCT Pub. No.: WO2018/004532
PCT Pub. Date: Jan. 4, 2018

(65) Prior Publication Data
US 2019/0329802 A1 Oct. 31, 2019

(51) Int. Cl.
*B61L 5/18* (2006.01)

(52) U.S. Cl.
CPC ..... *B61L 5/1845* (2013.01); *B61L 2207/02* (2013.01)

(58) Field of Classification Search
CPC ..... B61L 5/1845; B61L 2207/02; B61L 1/20; B61L 5/18; G08G 1/095; H05B 47/20
See application file for complete search history.

(56) References Cited

U.S. PATENT DOCUMENTS

2011/0157557 A1* 6/2011 Vogel ..... G09F 19/18 353/13
2014/0267875 A1* 9/2014 Gruhlke ..... H04N 5/332 348/335

FOREIGN PATENT DOCUMENTS

| | | | |
|---|---|---|---|
| DE | 3808965 | A1 | 1/1988 |
| DE | 3808965 | A1 | 12/1988 |
| GB | 2488230 | A | 8/2012 |
| WO | 2007066112 | A1 | 6/2007 |

OTHER PUBLICATIONS

PCT International Search Report and Written Opinion of International Searching Authority dated May 29, 2017 corresponding to PCT International Application No. PCT/US2016/039767 filed Jun. 26, 2016.

* cited by examiner

*Primary Examiner* — Daryl C Pope

(57) ABSTRACT

A light emitting diode (LED) shielding and monitoring system includes multiple light emitting diodes (LEDs) (12, 14, 82, 92), multiple optical detectors (20, 84, 94) for detecting a light output of the plurality of LEDs (12, 14, 82, 92), and a LED shield (30, 110) with multiple compartments (38, 114) for receiving the multiple optical detectors (20, 84, 94). The LED shield (30, 110) is configured such that each compartment (38, 114) receives an optical detector (20, 84, 94), and wherein each compartment (38, 114) is configured such that the optical detector (20, 84, 94) within the compartment (38, 114) detects the light output of a LED (12, 14, 82, 92) of the multiple LEDs (12, 14, 82, 92) without detecting light output other than the light output of the LED (12, 14, 82, 92). Further, wayside LED signals including a LED shielding and monitoring system are provided.

17 Claims, 8 Drawing Sheets

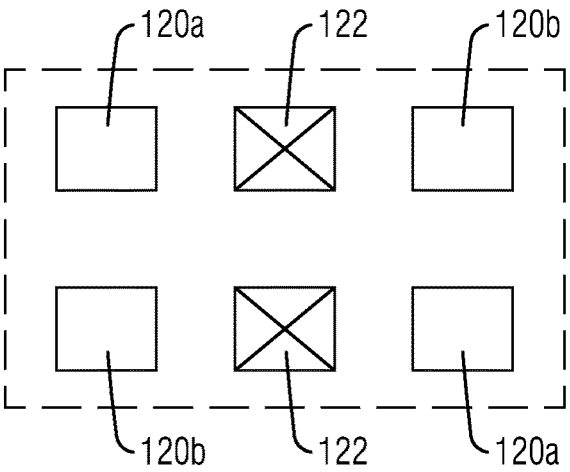
FIG. 13a
FIG. 13b
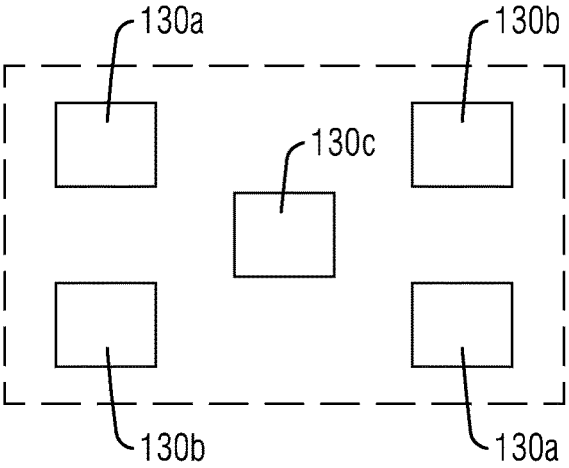
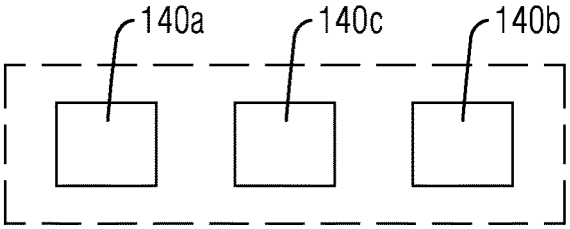
FIG. 13c
FIG. 13d
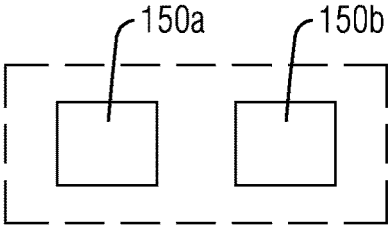

LED SHIELDING AND MONITORING SYSTEM AND WAYSIDE LED SIGNALS

CROSS REFERENCE TO RELATED APPLICATIONS

This Application is the U.S. National Stage of International Application No. PCT/US2016/039767 filed 28 Jun. 2016 and claims benefit thereof, the entire content of which is hereby incorporated herein by reference.

BACKGROUND

1. Field

Aspects of the present invention generally relate to a light emitting diode (LED) shielding and monitoring system and wayside LED signals.

2. Description of the Related Art

The railroad industry employs wayside signals to inform train operators of various types of operational parameters. For example, coloured wayside signal lights are often used to inform a train operator as to whether and how a train may enter a block of track associated with the wayside signal light. The status/colour of wayside signal lamps is sometimes referred to in the art as the signal aspect. One simple example is a three colour system known in the industry as Automatic Block Signaling (ABS), in which a red signal indicates that the block associated with the signal is occupied, a yellow signal indicates that the block associated with the signal is not occupied but the next block is occupied, and green indicates that both the block associated with the signal and the next block are unoccupied. It should be understood, however, that there are many different kinds of signaling systems. Other uses of signal lights to provide wayside status information include lights that indicate switch position, hazard detector status (e.g., broken rail detector, avalanche detector, bridge misalignment, grade crossing warning, etc.), search light mechanism position, among others.

Existing wayside signal lights can include incandescent bulbs or light emitting diodes (LEDs). The benefits of wayside signals with LEDs are improved visibility, higher reliability and lower power consumption.

Wayside signal lights are coupled to and controlled by a railway interlocking, also referred to as interlocking system or IXL, which is a safety-critical distributed system used to manage train routes and related signals in a station or line section, i.e. blocks of tracks. There are different interlocking types, for example vital relay-based systems or vital processor-based systems that are available from a wide variety of manufacturers.

The interlocking system permits hot and cold filament checks in order to detect lamp malfunction. While the terms 'hot and cold filament checks' originated with incandescent bulbs, the underlying concepts apply equally well to LED lighting. Hot-filament checking implies verifying that sufficient visible light is being emitted when the appropriate input is provided to the signal head. Cold filament checking proves that the filament of an incandescent lamp is intact, or that an LED signal is connected. This provides advance knowledge of a lamp failure so that the preceding aspects can be downgraded in advance, thus preventing a sudden unexpected downgrade.

The American Railway Engineering and Maintenance-of-Way Association (AREMA) defines hot filament testing for LED signals as a verification that 50% of the individual LEDs installed within the wayside signal are operating. The interlocking system performs hot filament testing by monitoring current drawn by the wayside signal; however, monitoring of a load does not necessarily give a true indication of light emitted from the signal. Modern LEDs emit light at high intensity with considerably less input power than incandescent bulbs, so most LED signals on the market emulate incandescent lamps by wasting power in dummy loads. The failure of several LEDs in the wayside signal does not necessarily change the current of the load significantly to allow detection of a failure by the interlocking. Additionally, light output of LEDs decreases as the devices age, meaning that the load seen by the interlocking from the LED signal as it ages will remain constant but the light output may eventually drop to a level below a minimum specification. Thus, there is a need for a system and wayside LED signals that provide monitoring of LEDs in a wayside signal so that a true evaluation of the light output of the LEDs is provided.

SUMMARY

Briefly described, aspects of the present invention relate to a LED shielding and monitoring system and wayside LED signals comprising a LED shielding and monitoring system. In particular, the LED signal is configured as a railroad wayside signal for installing along railroad tracks. One of ordinary skill in the art appreciates that such a LED signal can be configured to be installed in different environments where signals and signaling devices may be used, for example in road traffic.

A first aspect of the present invention provides a light emitting diode (LED) shielding and monitoring system comprising a plurality of light emitting diodes (LEDs); a plurality of optical detectors for detecting a light output of the plurality of LEDs; and a LED shield comprising a plurality of compartments for receiving the plurality of optical detectors, wherein the LED shield is configured such that each compartment receives at least one optical detector, and wherein each compartment is configured such that the at least one optical detector within the compartment detects the light output of at least one LED of the plurality of LEDs without detecting light output other than the light output of the at least one LED.

A second aspect of the present invention provides a wayside LED signal comprising a plurality of optical detectors for detecting a light output of a plurality of LEDs; a LED shield comprising a plurality of compartments for receiving the plurality of optical detectors, and a plurality of sections for receiving the plurality of LEDs; and a first lens for focusing the light output of the plurality of LEDs, wherein the LED shield is passively mounted to the first lens.

A third aspect of the present invention provides a wayside LED signal comprising a plurality of optical detectors for detecting a light output of a plurality of LEDs; a LED shield comprising a plurality of compartments for receiving the plurality of optical detectors, and a center section for receiving the plurality of LEDs; and a light guide for transmitting light generated by the plurality of LEDs, wherein the LED shield is configured as a housing, and wherein the plurality of optical detectors, the plurality of LEDs and the light guide are positioned inside the LED shield.

BRIEF DESCRIPTION OF THE DRAWINGS

FIGS. 13*a*, 13*b*, 13*c* and 13*d* illustrate basic schematics of alternative arrangements of LEDs for a wayside signal in accordance with exemplary embodiments of the present invention.

DETAILED DESCRIPTION

To facilitate an understanding of embodiments, principles, and features of the present invention, they are explained hereinafter with reference to implementation in illustrative embodiments. In particular, they are described in the context of being a LED shielding and monitoring system and wayside LED signals. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Wayside railroad signal display aspects provide the only means of authority for train movements in many control systems. In other control systems, the displayed aspect is important to ensure safe train separation. In all implementations, failure to display the desired aspect has a potential safety implication. To achieve safe railroad operations, the system should have a reliable method for determining that a signal aspect intended for display by the control system is, in fact, being displayed. Such a method may be referred to as light out detection. Light out detection is for example used for downgrading approach lights in the event of a signaling lamp failure.

Figure 1:
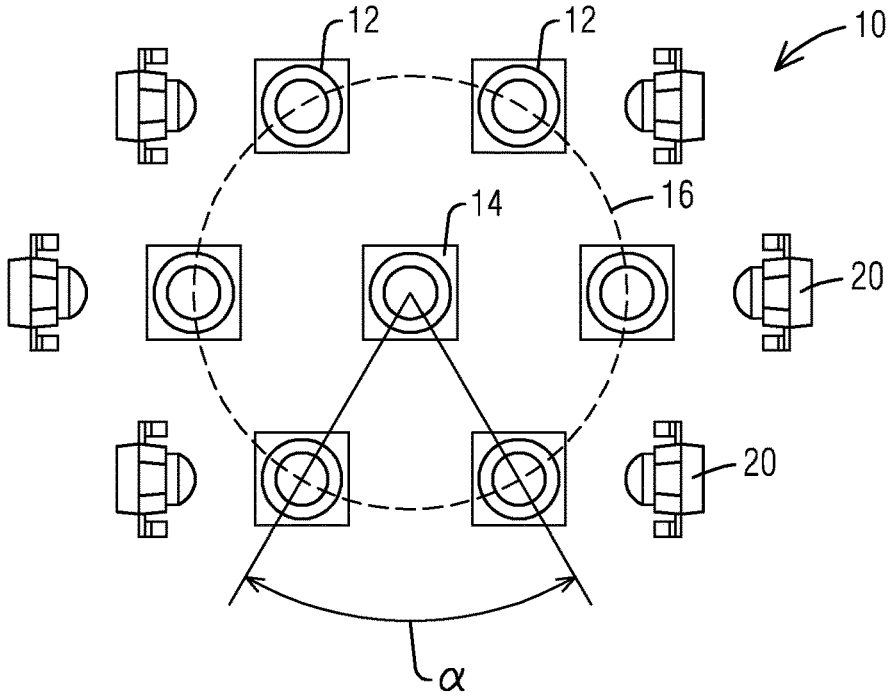
FIG. 1 illustrates a basic schematic of an arrangement of LEDs and optical detectors for a wayside signal in accordance with an exemplary embodiment of the present invention.

FIG. 1 illustrates a basic schematic of an arrangement 10 of LEDs 12, 14 and optical detectors 20 for a wayside signal in accordance with an exemplary embodiment of the present invention. Wayside signaling is moving away from incandescent lighting to LED lighting because LED signals, herein also referred to as LED signaling devices, have improved visibility, higher reliability and lower power consumption.

According to the embodiment of FIG. 1, an arrangement 10 comprises a plurality of LEDs 12, 14, in particular one center LED 14 and multiple outer LEDs 12. The outer LEDs 12 include six LEDs 12 arranged around the center LED 14 and along circle 16 with equal distances to each other. Such a configuration may also be referred to as hexapolar configuration. Angles $\alpha$ between the circularly arranged LEDs 12 are each 60°, measured from a center of the circle 16, which coincides with the location of the center LED 14.

The arrangement 10 further comprises a plurality of optical detectors 20. For example, the arrangement can comprise six optical detectors 20, wherein the six optical detectors 20 are assigned to the six outer circularly arranged LEDs 12. Specifically, one optical detector 20 is assigned to one outer LED 12, thus providing a single LED output control for each outer LED 12. Each optical detector 20 is arranged such that it detects light output from a designated LED 12, which, for example, can be the LED 12, 14 closest to the optical detector 20. However, in another configuration, for better shielding from ambient light, it might be advantageous to move an optical detector 20 away from the LED 12, 14, wherein the optical detector 20 could then be closer to a different LED 12, 14, which would then be the designated LED 12, 14 to monitor. As FIG. 1 shows, the center LED 14 is not monitored by an optical detector 20. It should be noted that the described arrangement 10 of LEDs 12, 14 and optical detectors 20 is only exemplary, and that many other numbers and/or arrangements of LEDs and optical detectors, for example two LEDs with two optical detectors, four LEDs with four optical detectors, or six LEDs (two rows of three LEDs) with four optical detectors, are possible, as described for example later with reference to FIGS. 8 and 9.

The optical detectors 20 can be for example photodiodes or phototransistors, in particular side-looking photodiodes. The arrangement 10 of the LEDs 12, 14 and optical detectors 20 is arranged on and supported by a printed circuit board (PCB) 22. Of course, the PCB 22 can comprise many other electronic components, such as for example LED driver units and/or processing units.

Figure 2:
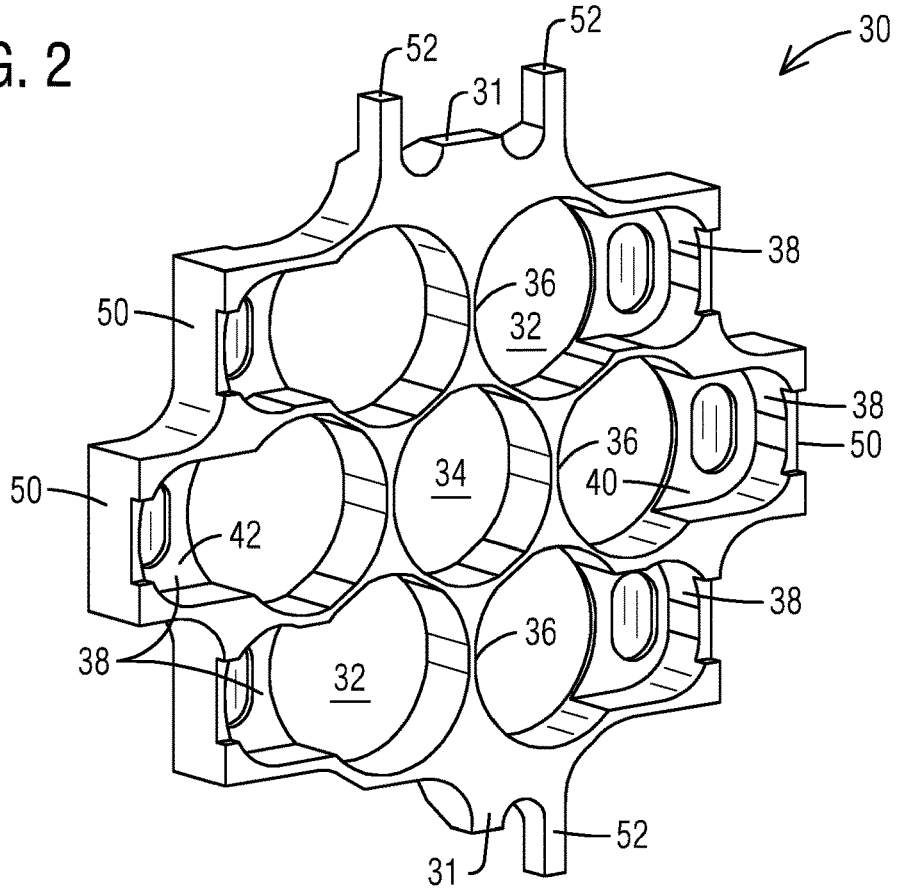
FIG. 2 illustrates a perspective view of a LED shield in accordance with an exemplary embodiment of the present invention.
Figure 3:
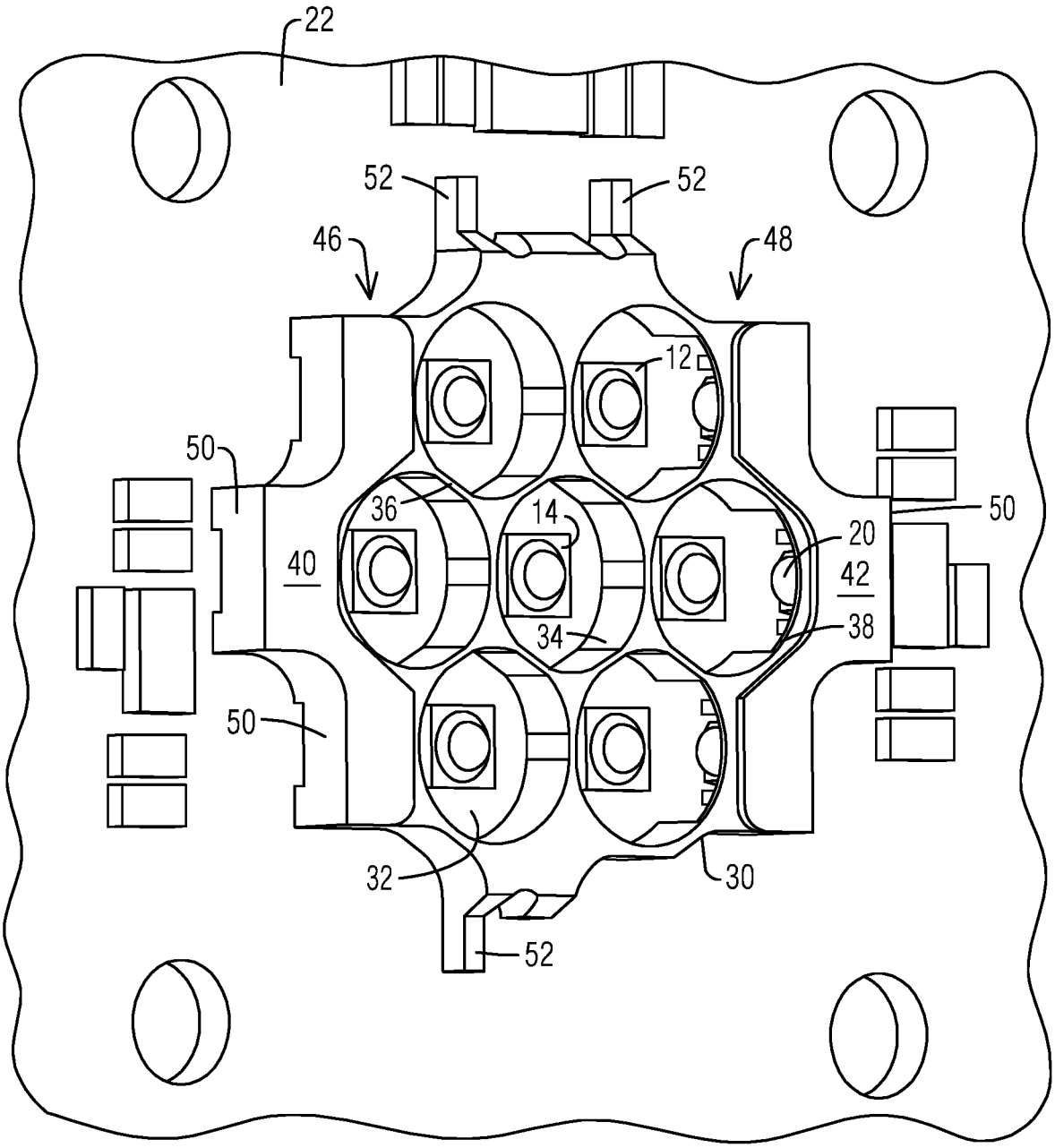
FIG. 3 illustrates a perspective view of the arrangement of LEDs and optical detectors as illustrated in FIG. 1 including a LED shield in accordance with an exemplary embodiment of the present invention.

FIG. 2 illustrates a perspective view of a LED shield 30, and FIG. 3 illustrates a perspective view of the arrangement 10 of LEDs 12, 14 and optical detectors 20 as described with reference to FIG. 1 including the LED shield 30 in accordance with exemplary embodiments of the present invention.

By arranging the LED shield 30 in a LED signal, each optical detector 20 only detects light output from the closest LED 12 and each optical detector 20 is protected from any ambient light, which is light not emitted by the LEDs 12, so that a true and correct evaluation of the light output of the LEDs 12 is provided. It should be noted that FIG. 2 illustrates a rear side view of the LED shield 30, wherein FIG. 3 illustrates a front side view of the LED shield 30.

When the LED shield 30 is arranged together with the LEDs 12, 14 and optical detectors 20 as shown in FIG. 3, the rear side of the LED shield 30 faces the PCB 22.

The LED shield 30 comprises a plurality of sections 32, 34 for shielding the LEDs 12, 14 from each other. The sections 32, 34 as shown in FIG. 2 are circular, but the sections 32, 34 can comprise many other forms or shapes suitable for shielding the LEDs 12, 14, such as for example square, hexagonal, octagonal, polygonal, oval, etc. Each section 32, 34 is separated by separation walls 36. With reference to FIG. 3, when the LED shield 30 is positioned on the PCB 22, each LED 12, 14 is located within a circular section 32, 34, specifically centric within the compartment 32, 34. In particular, the center LED 14 is arranged within center section 34, and the outer LEDs 12 are located within the outer sections 32. However, it should be noted that the LED shield 30 is not mounted to the PCB 22 as will be described later. The circular sections 32, 34 including the separation walls 36 around each LED 12, 14 provide a shielding functionality to ensure that each optical detector 20 only detects light from one LED 12.

The LED shield 30 further comprises a plurality of compartments 38 provided for receiving the optical detectors 20. Each compartment 38 receives an optical detector 20. In an exemplary embodiment of the present invention, each compartment 38 is adjacent to a circular section 32. As shown in FIG. 3, each compartment 38 is configured so that, when an optical detector 20 is arranged in the compartment 38, the optical detector 20 faces the LED 12 in the adjacent section 32 and is thus able to monitor and detect light output of the LED 12, i.e. each compartment 38 is open toward the LED 12. As noted before, the optical detectors 20 can be configured as side-looking photodiodes. A back side of the optical detector 20 faces an outer side wall 50 of the LED shield 30, outer walls 50 of the LED shield 30 forming parts of the compartments 38.

As FIG. 2 further illustrates, the compartments 38 are only provided for optical detectors 20 assigned to an outer LED 12 as only the outer LEDs 12 are monitored. In accordance with the configuration of outer LEDs 12 and optical detectors 20 as provided in FIG. 1, the compartments 38 are located on outer sides of the LED shield 30, for example three compartments 38 are located at a left outside 46 and three compartments 38 are located at a right outside 48 of the LED shield 30. Alternative embodiments can include radial arrangements of the optical detectors 20 relative to the LEDs 12, 14, where the optical detectors 20 are arranged circularly around the LEDs 12, 14. For example, an optical detector 20 is assigned to each outer LED 12, the optical detectors 20 being arranged on a circle around the outer LEDs 12 with equal distances between the optical detectors 20. For such a radial arrangement of the optical detectors 20, the LED shield 30 and the compartments 38 are modified accordingly so that the compartments 38 can receive the radially arranged optical detectors 20.

Each compartment 38 comprises a top cover which protects the optical detectors 20 within the compartment 38 from ambient light. According to an exemplary embodiment of the present invention, the LED shield 30 comprises a common top cover 40 for the three compartments 38 at the left outside 46 and a common top cover 42 of the three compartments 38 at the right outside 48 of the LED shield 30. Alternatively, each compartment 38 may comprise a separate top cover. Furthermore, the LED shield 30 comprises extensions 52 for mounting and aligning the LED shield 30 as will be described with reference to FIGS. 4 and 5.

In an exemplary embodiment of the present invention, the LED shield 30 comprises plastic material. Specifically, the LED shield 30 is an injection moulded plastic element. Alternatively, the LED shield 30 can be milled from plastics. In a further exemplary embodiment, the LED shield can comprise aluminum and can be a component formed, for example milled, from aluminum.

Figure 4:
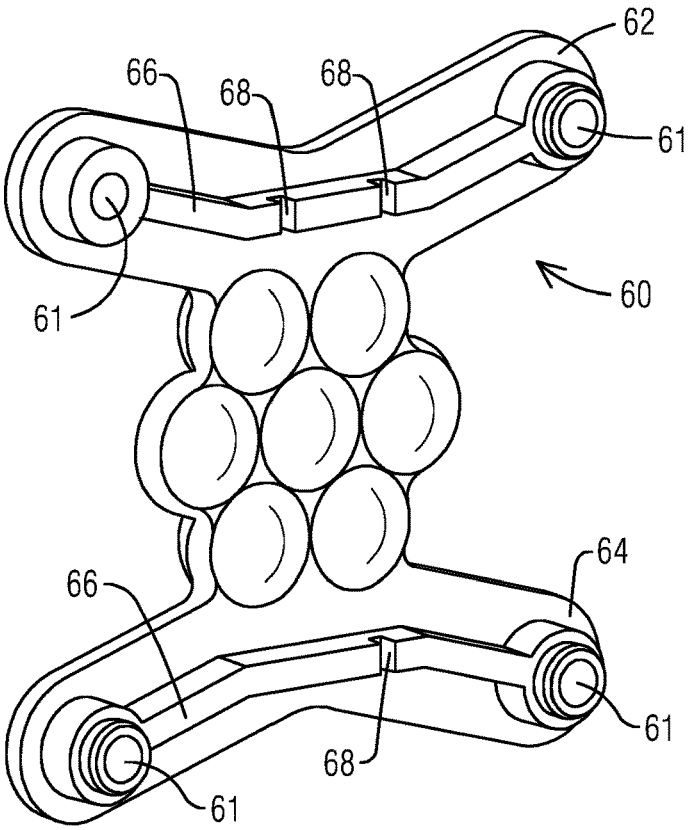
FIG. 4 illustrates a perspective view of a first lens for a LED signal configured to receive and hold the LED shield as illustrated in FIG. 2 in accordance with an exemplary embodiment of the present invention.
Figure 5:
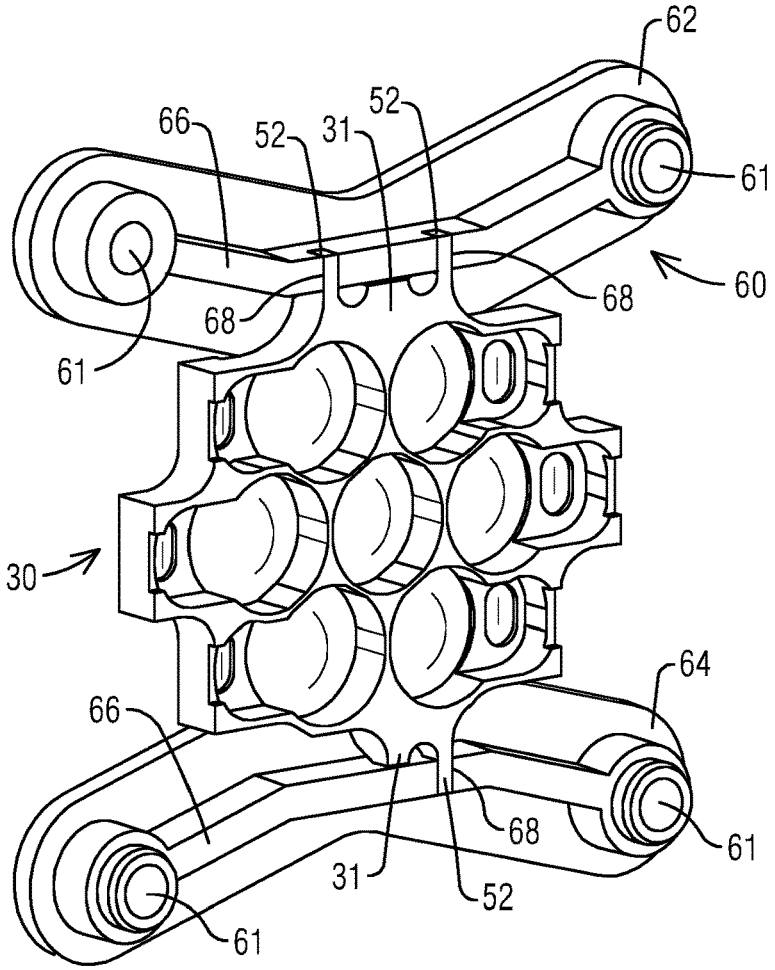
FIG. 5 illustrates a perspective view of the lens as illustrated in FIG. 4 in combination with the LED shield as illustrated in FIG. 2 in accordance with an exemplary embodiment of the present invention.

FIG. 4 illustrates a perspective view of a first lens 60 for a LED signal configured to receive and hold the LED shield 30, and FIG. 5 illustrates a perspective view of the lens 60 in combination with the LED shield 30 in accordance with exemplary embodiments of the present invention.

As noted before, the LED shield 30 is not mounted to the PCB 22, but is passively mounted to the first lens 60 which in turn is mounted to the PCB 22. The lens 60 is used for focusing light emitted by the LEDs 12, 14. FIGS. 4 and 5 illustrate rear side views of the lens 60. The lens 60 will not be described in detail herein as one of ordinary skill in the art is familiar with the general principle and construction of lenses. The first lens 60 can be a one-piece lens or can be an array of smaller lenses which are assembled and then form the first lens 60. Alternatively, the first lens 60 can be a one-piece moulded array of multiple lenses.

Figure 6:
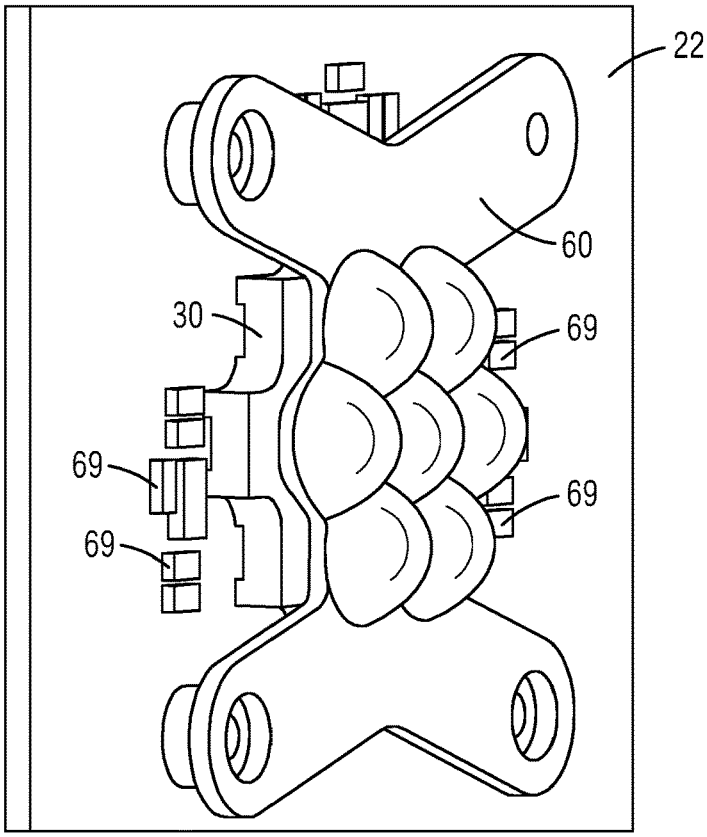
FIG. 6 illustrates a different perspective view of the lens in combination with the LED shield as illustrated in FIG. 5 in accordance with an exemplary embodiment of the present invention.

The lens 60 comprises mounting parts 62 and 64 for mounting the lens 60 to the PCB 22 (see FIG. 6). The mounting parts 62, 64 are arranged opposite each other on outer sides of the lens 60, for example on upper and lower sides of the lens 60. The mounting parts 62, 64 have an additional functionality, which is to provide support for the LED shield 30. Therefore, the mounting parts 62, 64 comprise mounting bars 66 and slots 68 for attaching and aligning the LED shield 30 to the lens 60. According to an exemplary embodiment, each mounting part 62 and 64 comprises a mounting bar 66 and at least one slot 68. Alternatively, only one of the parts 62, 64 can comprise the mounting bar 66 and at least one slot 68. Furthermore, the lens 60 comprises multiple openings 61, which can be for example threaded or tapped holes, for mounting the lens 60 to the PCB 22 via bolts or screws received in the openings 61. In alternative embodiments, the first lens 60 can be mounted to the PCB 22 by gluing, hot embossing, hot stamping and/or ultrasonic welding.

The LED shield 30 is mounted passively to the lens 60, which means that no additional mounting elements, for example screws or bolts, are necessary for mounting the LED shield 30. As described before, the LED shield 30 comprises the extensions 52. As FIG. 5 shows, the extensions 52 engage with the slots 68, wherein the bars 66 and slots 68 further provide alignment functionality for the LED shield 30. In turn, the LED shield 30 comprises bounding surfaces 31 which abut upon the mounting bars 66 thereby providing alignment in x-direction (x-alignment, see also FIG. 2). The extensions 52 of the LED shield 30 in combination with the slots 68 of the mounting parts 62, 64 provide alignment of the LED shield 30 in y-direction (y-alignment) and z-direction (z-alignment). Thus, a secure and aligned position of the LED shield 30 is provided. The described configuration of LEDs 12, 14, LED shield 30 and first lens 60 provides a compact arrangement. Compactness is achieved by mounting the LEDs 12, 14, the LED shield 30 and the first lens 60 axially together with low tolerances and by coupling the LED shield 30 to the first lens 60.

FIG. 6 illustrates a different perspective view of the lens 60 in combination with the LED shield 30 in accordance with an exemplary embodiment of the present invention. Specifically, FIG. 6 illustrates the lens 60 and LED shield 30 assembled and mounted to the PCB 22. While FIGS. 4 and 5 illustrate rear side views of the lens 60, FIG. 6 illustrates a front side view of the lens 60. The LEDs 12, 14 and optical detectors 20 cannot be seen because they are covered and protected by the LED shield 30 and the lens 60. Of course, FIG. 6 can comprise further electronic components as indicated by elements 69.

Figure 7:
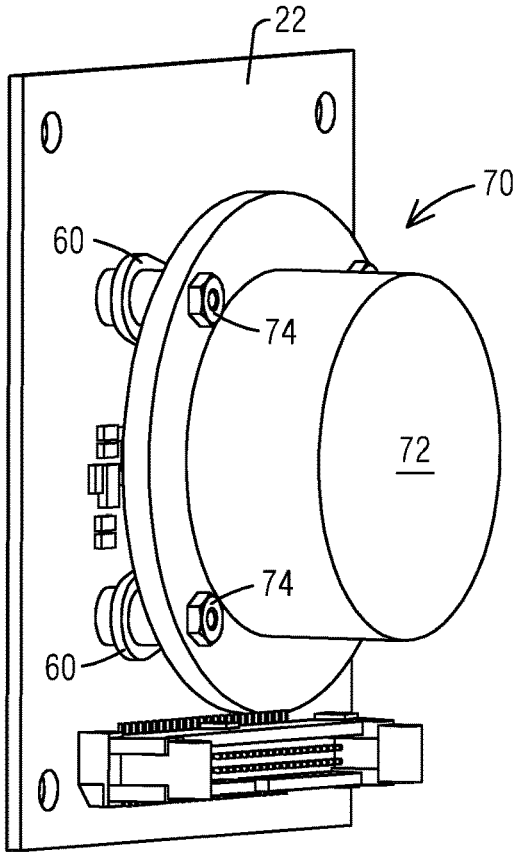
FIG. 7 illustrates a perspective view of a wayside LED signal in accordance with an exemplary embodiment of the present invention.

FIG. 7 illustrates a perspective view of a part of a wayside LED signal 70 in accordance with an exemplary embodiment of the present invention. The LED signal 70 comprises a second lens 72 arranged over the first lens 60. The second lens 72 as well as the first lens 60 are clear lenses, wherein a resulting signal colour is achieved by the emitting light colour of the LEDs 12, 14 (for example, red LEDs are used to provide a red signal colour). Also, lens 72 will not be described in detail herein as one of ordinary skill in the art is familiar with the general principle and construction of such lenses. The lens 72 comprises openings, for example threaded or tapped holes, for receiving bolts or screws 74 for mounting the lens 72 together with lens 60 and LED shield 30 to the PCB 22. As FIG. 7 shows, the lens 72 is mounted over the lens 60 and the LED shield 30 including the LEDs 12, 14 and optical detectors 20 to the PCB 22.

Of course, for operating the LED signal 70, the LEDs 12, 14 and optical detectors 20 are electrically connected within electronic circuits. For example, a LED circuit can comprise the LEDs 12, 14 and LED driver units coupled to and controlled by a railway interlocking. In parallel to the LED circuit, an optical output control circuit comprising the optical detectors 20 and further components required for monitoring and controlling light output of the LEDs 12, 14 is provided. The LED circuit as well as the optical output control circuit will not be described in detail herein. The LED signal 70 is configured such that the LED signal 70 does not indicate that light is being generated when less than 50% of the rated light output of the LEDs 12, 14 is being generated. According to an exemplary embodiment, a configuration of the LED signal 70 is such that when three of the monitored outer LEDs 12 fail, a shutdown of the LED signal 70 is triggered. This configuration takes into account that the center LED 14 may also be failing. But since the center LED 14 is not monitored by an optical detector 20, it is unknown if the center LED 14 is working properly or not. The proposed LED signal 70 meets the requirement for disconnect (shutdown) at less than 50% light output of the rated light output of the LEDs 12, 14, because the light output falls below 50% of the rated light output when four of the seven LEDs 12, 14 fail.

Figure 8:
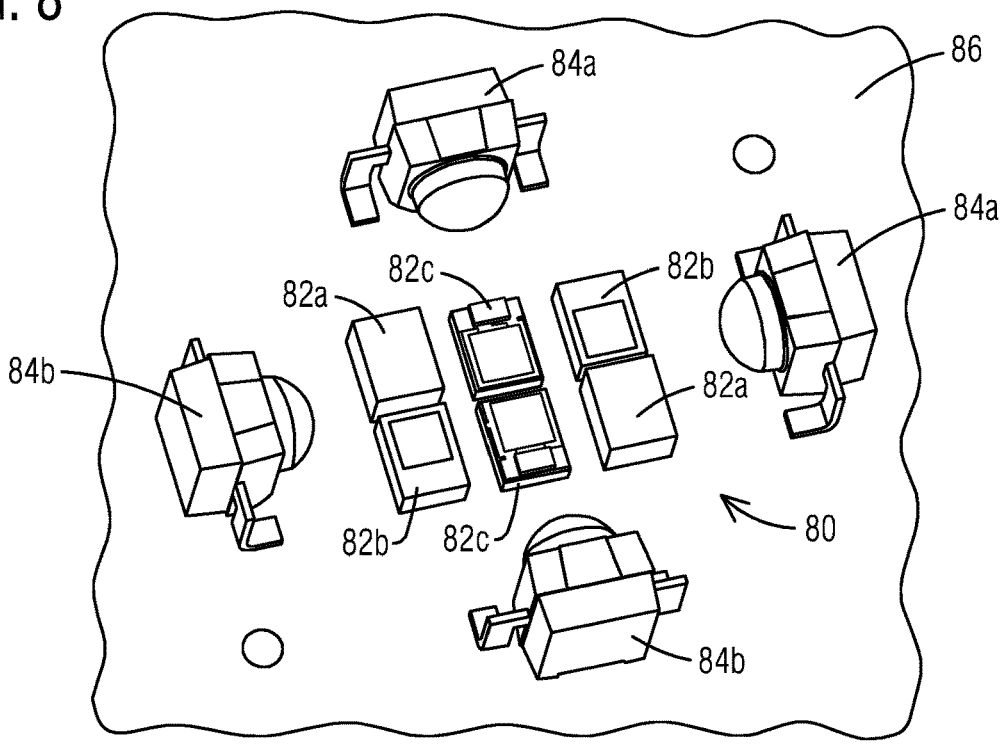
FIGS. 8 and 9 illustrate basic schematics of further arrangements of LEDs and optical detectors for a wayside LED signal in accordance with exemplary embodiments of the present invention.
Figure 9:
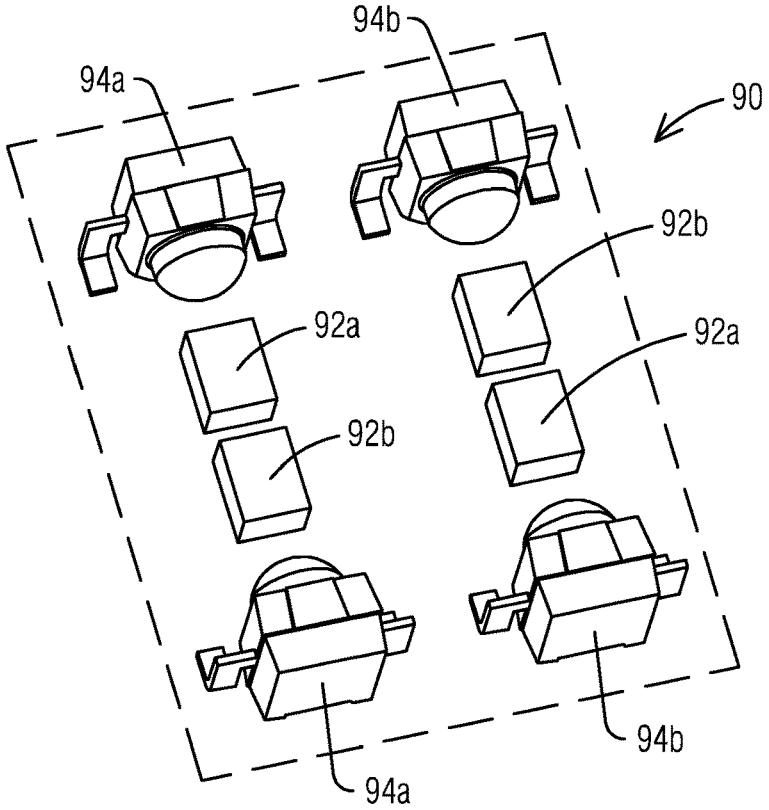

FIGS. 8 and 9 illustrate basic schematics of further arrangements 80, 90 of LEDs 82, 92 and optical detectors 84, 94 for a wayside LED signal in accordance with an exemplary embodiment of the present invention. As noted before when describing the arrangement 10 of FIG. 1, many other numbers and/or arrangements of LEDs and optical detectors are possible.

FIG. 8 illustrates an arrangement 80 comprising multiple, specifically six, LEDs 82 arranged in rows instead of a circle. The LEDs 82 are provided in three different colours, which can be for example red, yellow and green. Two LEDs 82 are from a same colour. The arrangement 80 comprises two red LEDs 82*a*, two yellow LEDs 82*b* and two green LEDs 82*c*. The red LEDs 82*a* are arranged in a diagonal configuration, and the yellow LEDs 82*b* are also arranged in a diagonal configuration. The green LEDs 82*c* are arranged next to each other ("vis-a-vis"), wherein each green LED 82*c* is located between a red and yellow LED 82*a*, 82*b*. It should be noted that the colours can be arranged in many different ways and any colour can be positioned at the center positions (FIG. 8 shows the green LEDs 82*c* in the center positions, but the red LEDs 82*a* or the green LEDs 82*b* could also be arranged in the center positions). The arrangement 80 comprises two rows of LEDs 82, wherein each row comprises a LED 82*a*, 82*b*, 82*c* of each colour.

The arrangement 80 further comprises multiple, specifically four, optical detectors 84 arranged around the LEDs 82. According to the embodiment of FIG. 8, two optical detectors 84*a* belong to a first control channel A, and two optical detectors 84*b* belong to a second control channel B. When the LED signal is in operation, only one set of LEDs 82 of a same colour emit light, i.e. are "on", and are monitored by the optical detectors 84*a*, 84*b*. For example, the LED signal can be configured such that only the set of red LEDs 82*a* is in operation, wherein all the optical detectors 84*a*, 84*b* monitor the red LEDs 82*a*. The same applies when the yellow LEDs 82*b* or green LEDs 82*c* are switched on.

FIG. 9 illustrates an arrangement 90 comprising multiple, specifically four, LEDs 92 arranged in two rows, each row comprising two LEDs 92*a*, 92*b*. The LEDs 92*a*, 92*b* are provided in two different colours. The arrangement 90 can be used for a LED signal comprising one or more aspects, for example two aspects, which are for example red and green. The sets of LEDs 92*a* and 92*b* are each arranged in a diagonal configuration. Furthermore, multiple optical detectors 94 are provided, wherein an optical detector 94 is arranged next to each LED 92*a*, 92*b*. Two optical detectors 94*a* belong to a first control channel A, and two optical detectors 94*b* belong to a second independent control channel B. When a LED signal comprising the arrangement 90 is in operation, all four LEDs 92 can be "on" at the same time, wherein the optical detectors 94 monitor light output of all four LEDs 92.

With reference to FIGS. 8 and 9, the optical detectors 84, 94 can be for example photodiodes or phototransistors, in particular side-looking photodiodes. The arrangements 80, 90 of the LEDs 82, 92 and optical detectors 84, 94 are each arranged on and supported by a printed circuit board (PCB) 86, 96, respectively. Of course, the PCB 86, 96 can comprise many other electronic components, such as for example LED driver units and/or processing units. According to an exemplary embodiment of the present invention, the LEDs 82, 92 can be chip-size, surface mounted devices (SMD), wherein FIGS. 8 and 9 show the LEDs 82, 92 without lenses (flat surface). Alternatively, many other types of LEDs with a large-angle light emission (for example emission greater than about 60°) can be used for the arrangements 80 and 90. It should be noted that many other arrangements of LEDs and optical detectors are conceivable, for example as described with reference to FIGS. 13*a*, 13*b* and 13*c*.

Figure 10:
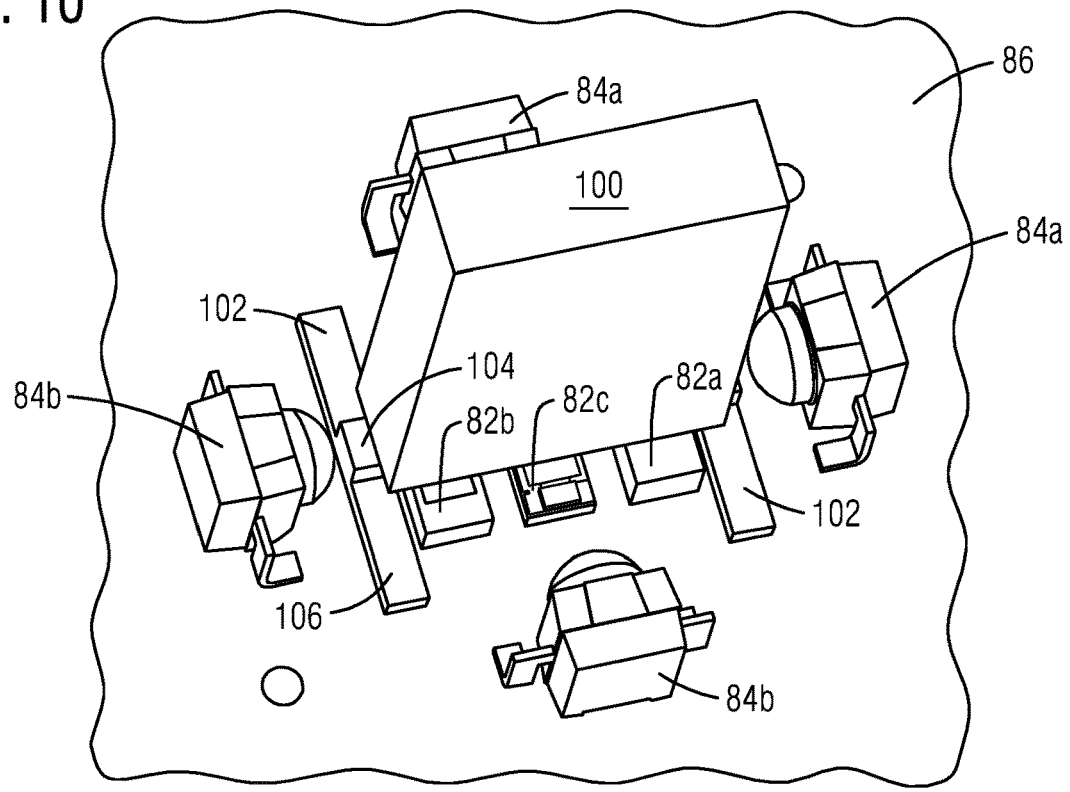
FIG. 10 illustrates a perspective view of the arrangement as illustrated in FIG. 8 and a light guide in accordance with an exemplary embodiment of the present invention.

FIG. 10 illustrates a perspective view of the arrangement 80 as illustrated in FIG. 8 and a light guide 100 in accordance with an exemplary embodiment of the present invention.

According to an exemplary embodiment of the present invention, light emitted from the multiple LEDs 82*a*, 82*b*, 82*c* is coupled into the light guide 100. The light guide 100 comprises rectangular surfaces and is configured in shape of a cuboid. Of course, the light guide 100 can be configured in many other suitable forms and shapes. The light guide 100 will not be described in detail herein as one of ordinary skill in the art is familiar with the principle and construction of such a light guide. Briefly explained, a light guide is a device designed to transport light from a light source to a point at some distance with minimal loss by means of total internal reflection. Light guides are usually made of optical grade materials such as acrylic resin, polycarbonate, epoxies, and glass.

Figure 12:
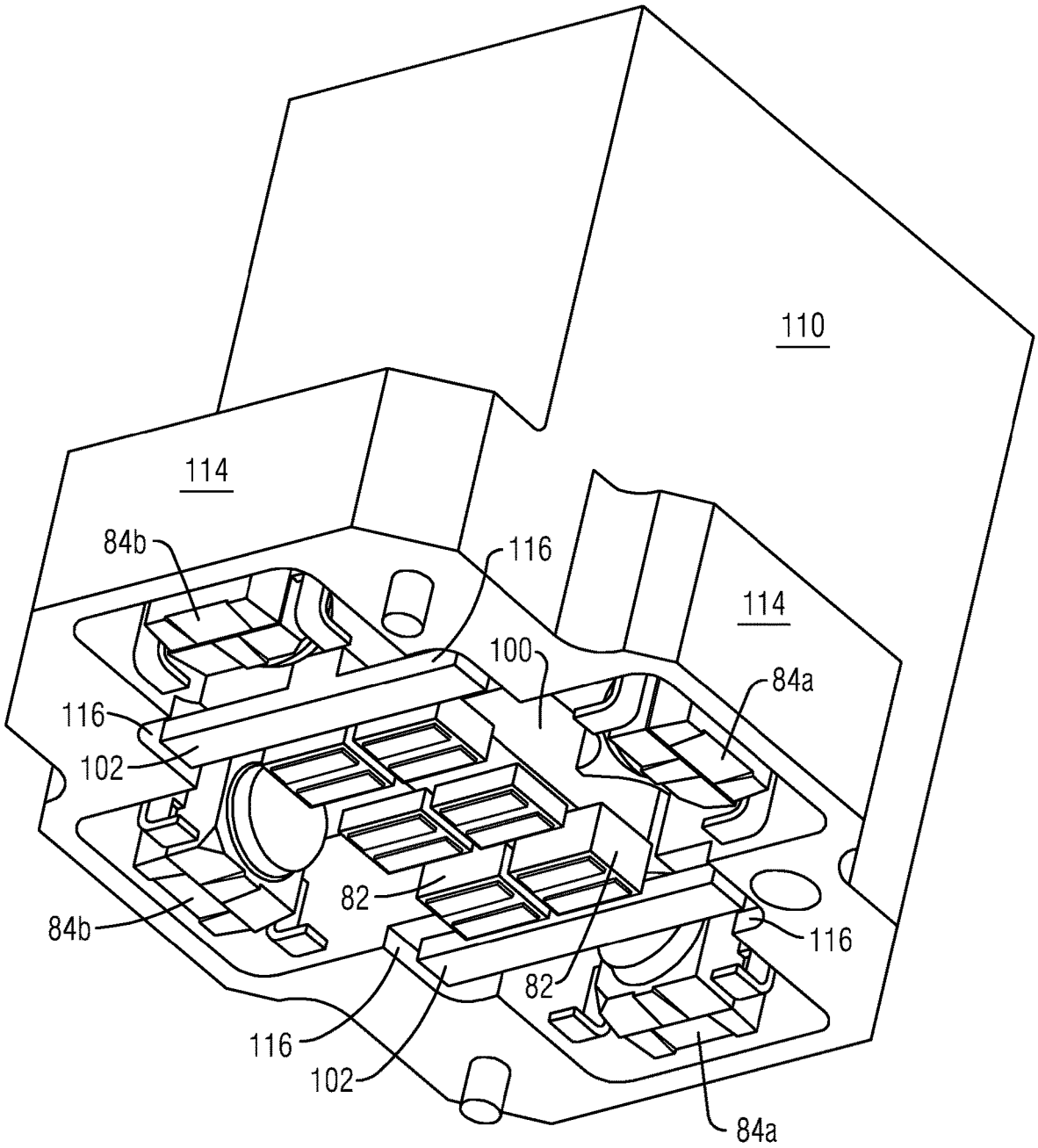
FIG. 12 illustrates a different perspective view, specifically a perspective bottom view, of the arrangement, light guide and LED shield as illustrated in FIGS. 10 and 11, in accordance with an exemplary embodiment of the present invention.

FIG. 10 further illustrates at least two spacers or standoffs 102 for supporting the light guide 100 and a LED shield 110, herein also referred to as housing 110 (see FIG. 12). The standoffs 102 are arranged opposite to each other, wherein each standoff 102 is arranged between an optical detector 84*a*, 84*b* and the LEDs 82. The standoffs 102 are mounted to the PCB 86, for example by soldering or gluing. Each standoff 102 is designed as an elongated bar comprising at least two planes at different heights. As FIG. 10 shows, each standoff 102 comprises first plane 104 at a first height, and second plane 106 at a second height. The first plane 104 specifically supports the light guide 100 and serves as a "stop" when arranging the light guide 100. The second plane 106 serves as a "stop" and guide when arranging the LED shield 110 (see also FIG. 12). Thus, only one element, which is the standoff 102, is necessary for arranging and supporting both the light guide 100 and the LED shield 110.

Figure 11:
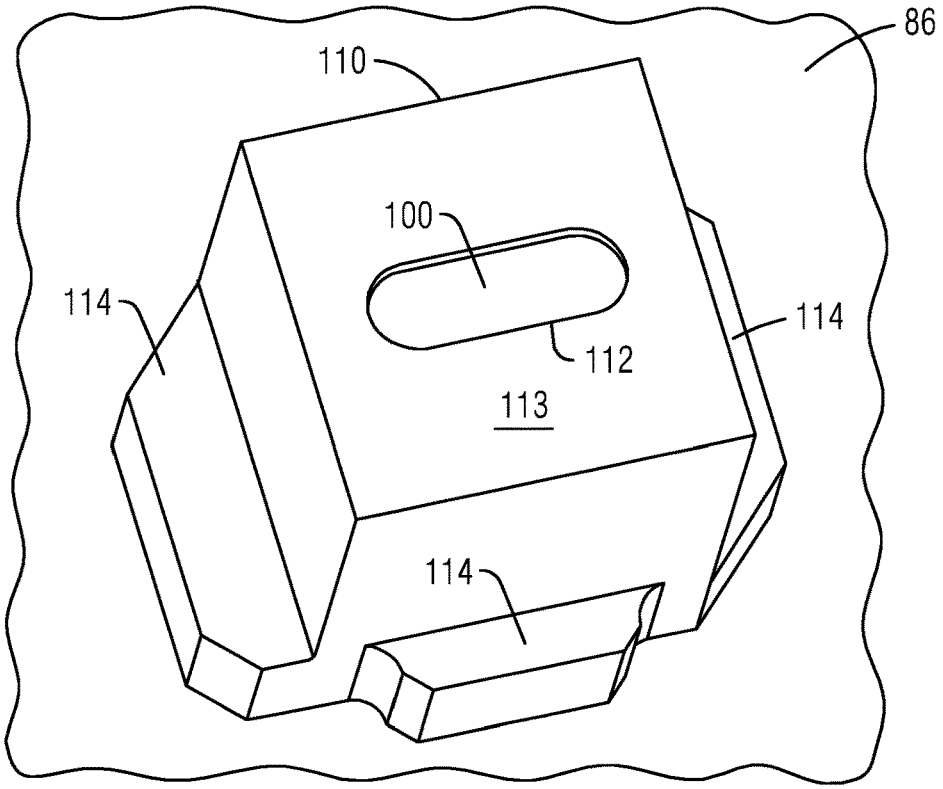
FIG. 11 illustrates a perspective view of the arrangement with light guide as illustrated in FIG. 10 and a LED shield in accordance with an exemplary embodiment of the present invention.

FIG. 11 illustrates a perspective view of the arrangement 80 with light guide 100 as illustrated in FIG. 10 and the LED shield 110 in accordance with an exemplary embodiment of the present invention. The LED shield 110 covers the light guide 100 as well as the arrangement 80 of LEDs 82 and optical detectors 84. Thus, the optical detectors 84 and the LEDs 82 cannot be seen in FIG. 11, because they are entirely covered by the LED shield 110.

The LED shield 110 comprises multiple compartments 114 which cover and enclose the optical detectors 84 from ambient light, which is light not generated from the LEDs 84, so that a true and correct evaluation of the light output of the LEDs 84 is provided. In accordance with the arrangement of optical detectors 84 of FIG. 8, one compartment 114 is provided for each optical detector 84. In combination with the arrangement of optical detectors 94 of FIG. 9, two optical detectors 94 can be placed in one compartment, wherein two compartments 114 each can receive a set of optical detectors 94*a*, 94*b*. The compartments 114 each comprise a top and side walls which surround the optical detectors 84, wherein the compartments 114 are open toward the LEDs 82 so that the optical detectors 84 can monitor the LEDs 82 (see also FIG. 12). The compartments 114 of the housing 110 surround the optical detectors 84 partially, specifically at three sides, wherein at a fourth side, the compartment 114 is open towards the plurality of LEDs 82 so that the optical detectors 84 can receive, detect and monitor light generated by the LEDs 82. Furthermore, the LED shield 110 comprises a center section 113 for receiving and covering the plurality of LEDs 82 as well as the light guide 100.

The LED shield (housing) 110 comprises an elongated opening 112 for emitting light generated by the LEDs 82 and transmitted by the light guide 100. The LED shield (housing) 110 can comprise more than one opening 112.

In an exemplary embodiment of the present invention, the LED shield (housing) 110 with the compartments 114 comprises metal, specifically is entirely made of metal. Alternatively, the LED shield 110 can comprise plastic material, for example can be a moulded plastic part.

FIG. 12 illustrates a different perspective view, specifically a perspective bottom view, of the arrangement 80, light guide 100 and LED shield 110 in accordance with an exemplary embodiment of the present invention. The LED shield (housing) 110 is mountable to the PCB 86 (which is removed and not shown in FIG. 12) and covers the LEDs 82, optical detectors 84 and light guide 100.

FIG. 12 further shows how the standoffs 102 provide mounting support for the light guide 100 and the LED shield 110. For example, the LED shield 110 can comprise one or more recesses 116 providing guidance for correctly placing the housing 110 over the LEDs 82, optical detectors 84 and light guide 100. When positioning the LED shield 110 over the light guide 100, LEDs 82 and optical detectors 84, the recesses 116 of the LED shield 110 partially encompass the two standoffs 102, specifically the second plane 106 of the standoffs 102. Thus, the standoffs 102 provide guidance and limitation when placing the LED shield 110.

As noted before, in operation, the arrangements 80, 90 comprising the LEDs 82, 92 and optical detectors 84, 94 are electrically connected within electronic circuits. For example, a LED circuit can comprise the LEDs 82, 92 and LED driver units coupled to and controlled by a railway interlocking. In parallel to the LED circuit, an optical output control circuit comprising the optical detectors 84, 94 and further components required for monitoring and controlling light output of the LEDs 82, 92 can be provided. The LED circuit as well as the optical output control circuit will not be described in detail herein. Each optical detector 84, 94 detects light from both LEDs 82, 92 of one colour. For example, with reference to the arrangement 80 of FIG. 8, each optical detector 84*a*, 84*b* will detect light of both red LEDs 82*a*, when the red LEDs 82*a* are on (each detector 84*a*, 84*b* will detect more light from the closer red LED 82*a* and less light from the more distant red LED 82*a*). Signals of the two optical detectors 84*a*, 84*b* of one control channel (detectors 84*a* belong to the first control channel A, and detectors 84*b* belong to the second control channel B) can then be analyzes such that a status of both red LEDs 82*a* can be identified as a) "both LED on", b) "one LED on", or c) "no LED on". The same principle applies to the arrangement 90 as illustrated in FIG. 9. Since all LEDs 82, 92 are monitored and checked, dedicated failure detection is available.

FIGS. 13*a*, 13*b*, 13*c* and 13*d* illustrate basic schematics of alternative arrangements of LEDs 120, 130, 140, 150 for a wayside signal in accordance with exemplary embodiments of the present invention.

FIG. 13*a* illustrates an arrangement of LEDs 120*a* and 120*b* similar to the arrangement of FIG. 8. The arrangement comprises two rows each including three positions for LEDs 120*a*, 120*b*. The center positions 122 are not used, i.e. no LEDs are located at the center positions. LEDs 120*a* are of a same colour (for example red), and LEDs 120*b* are of a same colour (for example green). But all the LEDs 120*a* and 120*b* can also comprise the same colour. In operation, LEDs 120*a*, 120*b* of a same colour are all switched on. Similar to the arrangement of FIG. 9, two independent control channels A and B of optical detectors can be arranged for detecting light output of the LEDs 120*a*, 120*b*, wherein the control channels A and B can be arranged next to the LEDs 120*a*, 120*b* as illustrated in FIG. 9. Both control channels A and B are configured such that they are monitoring and detecting the light output simultaneously, i.e. they are "on" at the same time. Such a configuration can be also referred to as double filament operation.

FIG. 13*b* illustrates an arrangement comprising five LEDs 130*a*, 130*b*, 130*c*, wherein one LED 130*c* is at a center position, and two LEDs 130*a*, 130*b* are arranged at both sides of the center LED 130*c*. One center LED 130*c* is sufficient to achieve a symmetrical beam shape. LEDs 130*a* are of a same colour, and LEDs 130*b* are of a same colour. In operation, LEDs of a same colour are switched on. The center LED 130*c* can comprise a different colour than LEDs

130*a*, 130*b*. In such a case, the center LED 130*c* needs to the most efficient of the three colours and can be for example a white LED.

FIG. 13*c* illustrates an arrangement comprising three LEDs 140*a*, 140*b*, 140*c*, wherein each LED 140*a*, 140*b* and 140*c* comprises a different colour. Although the arrangement of FIG. 13*c* provides a cost efficient solution since only three LEDs 140*a*, 140*b*, 140*c* are needed, the outer LEDs 140*a* and 140*b* may provide an unsymmetrical beam shape because the LEDs 140*a* and 140*b* are not positioned symmetrically (centrically) relative to the light guide 100, see for example FIGS. 10 and 11.

FIG. 13*d* illustrates an arrangement comprising two LEDs 150*a*, 150*b*. LEDs 150*a*, 150*b* can be of a same colour, or can be of different colours. In operation, LEDs 150*a*, 150*b* of a same colour are switched on at the same time. Similar to the arrangement of FIG. 9, two independent control channels A and B of optical detectors can be arranged for detecting light output of the LEDs 150*a*, 150*b*, wherein the control channels A and B can be arranged next to the LEDs 150*a*, 150*b*.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

The invention claimed is:

1. A light emitting diode (LED) shielding and monitoring system comprising:

a plurality of light emitting diodes (LEDs);

a plurality of optical detectors for detecting a light output of the plurality of LEDs; and a LED shield comprising a plurality of compartments for receiving the plurality of optical detectors, wherein the LED shield is configured such that each compartment receives at least one optical detector, and wherein each compartment is configured such that the at least one optical detector within the compartment detects the light output of at least one LED of the plurality of LEDs without detecting light output other than the light output of the at least one LED, wherein the LED shield comprises at least one extension and at least one bounding surface for mounting and aligning the LED shield.

2. The LED shielding and monitoring system as claimed in claim 1, wherein the plurality of optical detectors is selected from the group consisting of a photodiode, a phototransistor, a photo-resistor, light-dependent resistor, a photocell, and a combination thereof.

3. The LED shielding and monitoring system as claimed in claim 1, wherein each compartment of the LED shield comprises a top cover and side walls for partially covering the optical detectors, and wherein the compartments are open toward the plurality of LEDs.

4. The LED shielding and monitoring system as claimed in claim 1, wherein the plurality of LEDs and optical detectors are mounted to a common printed circuit board (PCB).

5. The LED shielding and monitoring system as claimed in claim 1, wherein the LED shield comprises a plurality of sections separated by separation walls for receiving the plurality of LEDs, and wherein each section is adjacent to a compartment.

6. The LED shielding and monitoring system as claimed in claim 1, wherein the LED shield is a one-piece injection molded plastic element.

7. The LED shielding and monitoring system as claimed in claim 1, further comprising:

a first lens comprising mounting parts with mounting bars and at least one mounting slot, wherein the at least one extension of the LED shield engages with the at least one mounting slot of the mounting parts.

8. The LED shielding and monitoring system as claimed in claim 7, wherein the first lens is mounted to the common PCB.

9. The LED shielding and monitoring system as claimed in claim 1, wherein the plurality of compartments are configured such that each optical detector within a compartment detects light output generated by more than the at least one LED.

10. The LED shielding and monitoring system as claimed in claim 1, wherein the LED shield further comprises a center section for housing the plurality of LEDs and optical detectors.

11. The LED shielding and monitoring system as claimed in claim 1, further comprising:

a light guide; and at least one standoff comprising first and second planes at different heights, wherein the light guide rests on the first plane.

12. The LED shielding and monitoring system as claimed in claim 11, wherein the second plane of the at least one standoff provides mounting support for the LED shield, and wherein, when positioning the LED shield, recesses of the LED shield partially encompass the at least one standoff.

13. The LED shielding and monitoring system as claimed in claim 1, wherein the LED shield comprises metal.

14. A wayside LED signal comprising:

a LED shielding and monitoring system comprising:

a plurality of light emitting diodes (LEDs);

a plurality of optical detectors for detecting a light output of the plurality of LEDs; and a LED shield comprising a plurality of compartments for receiving the plurality of optical detectors, wherein the LED shield is configured such that each compartment receives at least one optical detector, and wherein each compartment is configured such that the at least one optical detector within the compartment detects the light output of at least one LED of the plurality of LEDs without detecting light output other than the light output of the at least one LED, wherein the LED shield comprises at least one extension and at least one bounding surface for mounting and aligning the LED shield, and a first lens for focusing the light output of the plurality of LEDs, wherein the LED shield is passively mounted to the first lens.

15. The wayside LED signal as claimed in claim 14, wherein the plurality of optical detectors, the plurality of LEDs and the first lens are mounted to a common printed circuit board (PCB).

16. A wayside LED signal comprising:

a plurality of optical detectors for detecting a light output of a plurality of LEDs;

a LED shield comprising a plurality of compartments for receiving the plurality of optical detectors, and a center section for receiving the plurality of LEDs; and a light guide for transmitting light generated by the plurality of LEDs, wherein the LED shield is configured as a housing, and wherein the plurality of optical detectors, the plurality of LEDs and the light guide are positioned inside the LED shield, wherein the plurality of optical detectors are configured to detect light output generated by more than one LED.

17. The wayside LED signal as claimed in claim 16, wherein the LED shield comprises an opening for emitting light generated by the plurality of LEDs, the light guide transmitting the light from the plurality of LEDs to the opening of the LED shield.

* * * * *